United States Patent [19]

Parker et al.

[11] 4,399,650

[45] Aug. 23, 1983

[54] FRICTION TYPE YARN SPINNER

[76] Inventors: Alan Parker, 7 Darvel Close, Breightmet, Bolton, Lancashire; William M. Farnhill, 335 Colne Rd., Burnley, Lancashire, both of England

[21] Appl. No.: 324,465

[22] Filed: Nov. 24, 1981

Related U.S. Application Data

[63] Continuation-in-part of Ser. No. 88,262, Oct. 25, 1979, Pat. No. 4,315,398.

[30] Foreign Application Priority Data

Oct. 26, 1978 [GB] United Kingdom ..... 42074/78
Jun. 6, 1979 [GB] United Kingdom ..... 7926163
Aug. 4, 1979 [GB] United Kingdom ..... 7927245

[51] Int. Cl.[3] ..... D01H 1/135
[52] U.S. Cl. ..... 57/401
[58] Field of Search ..... 57/400, 401, 403, 404, 57/408, 410, 411

[56] References Cited

U.S. PATENT DOCUMENTS 4,107,909 8/1978 Fehrer et al. ..... 57/401 X
4,109,454 8/1978 Fehrer et al. ..... 57/401
4,130,983 12/1978 Dammann et al. ..... 57/336 X
4,148,177 4/1979 Fehrer ..... 57/401
4,168,601 9/1979 Didek et al. ..... 57/401
4,202,163 5/1980 Turk et al. ..... 57/401
4,249,368 2/1981 Fehrer ..... 57/401 X

*Primary Examiner*—Donald Watkins
*Attorney, Agent, or Firm*—Donald H. Feldman

[57] ABSTRACT

This friction spinner includes an opening roller system for feeding fibers to and through a feed duct to a throat formed between the adjacent peripheral surfaces of two parallel drum rollers rotating in the same direction, one roller perforate so that air may be drawn thereinto through its peripheral surface, and the other imperforate, and rotating such that the imperforate roller rotates out of the throat and the perforate roller rotates into the throat when viewed from above. Yarn formed at the throat, by frictional contact of the fed fibers with the rotating surfaces, is withdrawn along the throat. The fiber feed duct is arranged to feed the fibers in an airstream having a direction inclined to the yarn axis of yarn being formed at the throat and providing a component of fiber movement opposite to the direction of yarn withdrawal, which is to say transverse thereto. An additional airstream is provided across the duct close to its opening within the throat substantially parallel to the direction of the yarn axis as it is formed to turn the fibers from the direction of inclination of the duct to a direction more nearly parallel to the yarn axis as they approach the duct mouth opening.

4 Claims, 5 Drawing Figures

FRICTION TYPE YARN SPINNER

CROSS-REFERENCE TO A RELATED APPLICATION

This application is a continuation-in-part of copending U.S. appln. Ser. No. 88,262 as filed on Oct. 25, 1979, now U.S. Pat. No. 4,315,398, by the same coinventors, having the same assignee, and entitled, "Open-End Spinning Apparatus."

FIELD OF THE INVENTION

The invention relates to a yarn making apparatus of the kind known to the art as an open-end spinner, and more particularly a friction spinner. The particular type of friction spinner here concerned uses two right circular cylindrical rollers spaced axially parallel and in close adjacency to one another to define therebetween a yarn formation zone, sometimes called the throat or cusp. Discrete fibers are fed to the cusp through some means such as a tube or duct, there to be drawn to one or both rollers by currents of air being pulled through the peripheral roller surface through perforations in the surface. Then, as the rollers rotate in close proximity they twist the fibers therebetween into an elongate strand, a yarn, and the yarn is withdrawn from the cusp in the direction of the yarn axis usually. This form of yarn making has as its desirable feature a production speed several times that of other open end spinners, such as rotor spinners.

BACKGROUND OF THE INVENTION

A distinct disadvantage hitherto known is that, using otherwise identical fiber stocks, yarns produced by prior art friction spinners have poorer physical qualities, such as tensile strength, than do yarns produced by rotor spinners.

Known friction spinners include those disclosed in U.S. Pat. Nos. 3,636,693 and 4,168,601, which we shall call class one friction spinners, U.S. Pat. No. 4,202,163, which we shall call class two friction spinners, and those as disclosed in U.S. Pat. No. 4,148,177 which we shall call class three friction spinners.

Class one friction spinners are characterized by the deposition of fibers on a roller with a perforated surface, the suction through which holds the fibers thereon, at a location at some distance from the yarn forming zone and are brought into the yarn formation zone adhering to that revolving perforate surface. Upon reaching the yarn formation zone, the fibers on the held surface have to be reoriented and twisted to form the yarn. Problems in forming yarn of desirable physical qualities have been encountered, due it is now believed to the difficulties in reorienting the staple fibers to provide the desired axial alignment for good yarn formation.

Class two spinners employ both rollers perforated and having air drawn thereinto, both rotating in the same direction or sense, clockwise or anticlockwise, and having discrete fibers fed directly into the yarn formation zone in the cusp space therebetween. Thus, while indeed at least one perforated roller rotates from without the cusp-space into the yarn formation zone and towards the zone of closest adjacency of the surfaces of the rolls, on the other hand at least one (the other) roller which is perforated rotates in the direction from the zone of closest adjacency of the surfaces through the zone of yarn formation and thence outwardly therefrom. Class two spinners are known to be commercially useful in yarn making, however, to the best of present knowledge such yarns so made suffer from the problems of somewhat poorer physical qualities as above indicated. Again, it is believed that the underlying problems relate to fiber twisting as acted upon by the two cylindrical surfaces rotating into and out of the yarn formation zone as well as by the suctional forces pulling antagonistically from both sides of the yarn formation zone at the surfaces of both rollers. Further, mechanical complexities concerning suction piping and the like, as well as the increased economic cost burdens involved in the need to move large volumes of air through the yarn formation zone to and through both rollers surfaces provide for other disadvantages.

The third class of spinners is intimated at but not described by U.S. Pat. No. 4,202,163, by the words, "It is also possible, however, to use the invention on spinning apparatuses which have only one air-permeable roller and an air suction unit disposed in it . . . ." Class three spinners are characterized by one perforated roller with air suction and another roller with no air suction, preferably an imperforate roller, and most preferably by one with an irregular surface to permit better adhesion or frictional contact with the discrete fibers; all of the foregoing are disclosed in U.S. Pat. No. 4,148,177 aforementioned. Additionally, class three spinners are characterized by the rotation of both rollers in the same sense, and movement of the perforate roller from the zone of closest adjacency of the rollers' surfaces to and through the zone of yarn formation or cusp-zone, and thence away from the cusp-zone, and thus the movement of the imperforate roller into the cusp-zone of yarn formation towards the zone of closest adjacency of the rollers' surfaces. Here it is believed that again one does not obtain sufficient control over axial orientation of the fibers due to the frictional and suctional forces acting upon the fibers and their bundle being somewhat indeterminate, as is the twisting of the fibers into the bundle to produce the yarn. Up to the advent of this invention now to be defined, the art lacked the fullness of appreciation of the criticality of the interaction-combination of factors of how the discrete fibers are introduced into the cusp-zone, and how and of what type of axially parallel rollers are to be rotated in order to provide the desired degree of control over the fibers, how they are axially oriented relative one another and the fiber bundle formed, how they are twisted into the bundle in order to form a yarn of substantially improved physical qualities more nearly approaching that obtained by rotor spinners.

SUMMARY OF THE INVENTION

It is now discovered that such improved physical qualities are obtained in yarn made on a friction spinner wherein, in combination, the discrete fibers are fed to the yarn formation zone between the two rotating rollers directly, such as by having the exit mouth of the duct delivering the fibers terminate within the cusp-zone; the rotating right-cylindrical rollers are rotated in the same sense, either clockwise or anticlockwise, such that one, a perforate roller having a suction source pulling air through its peripheral surface thereinto, when looked at in side elevation, rotates toward and into the cusp-zone of yarn formation and then into and through the zone of closest adjacency of the surfaces of the rollers, and that the other is an imperforate roller which is rotated through the zone of closest adjacency of the surfaces to and through and out of the cusp-zone. It is found that this combination of very close feeding of the fibers to the rotating rollers within the cusp-zone and the prescribed rotational direction of the perforate and the imperforate rollers such that the perforate roller always rotates into and through the yarn formation zone from the top and past the imperforate roller and then past the zone of closest approach of the rollers, while the imperforate roller always rotates up out of and through the zone of closest approach and the cusp-zone respectively and then out of the cusp-zone and away from the other, perforate roller, provides such a desirable yarn.

DESCRIPTION OF A PREFERRED EMBODIMENT

Figure 4:
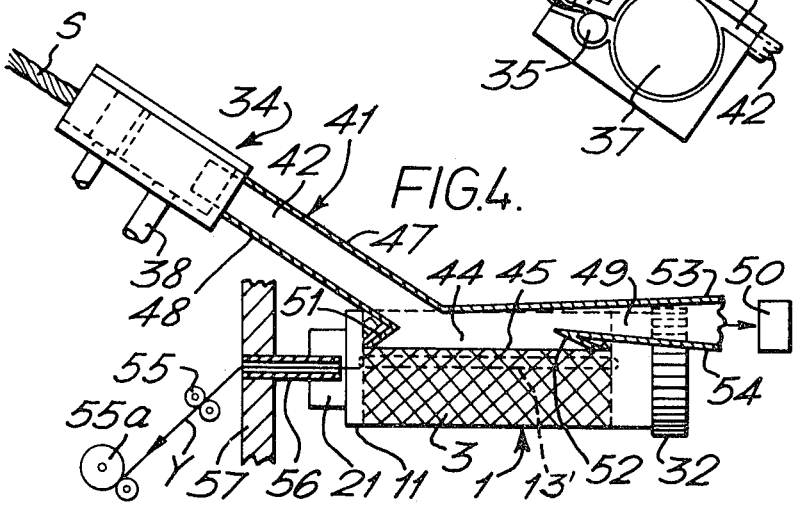
FIG. 4 shows the apparatus in section viewed along line IV—IV of FIG. 1.

With reference to the figures, the present apparatus includes rollers 1 and 2 in the form of right-circular cylinders, roller 1 being perforate at its surface area 3, the latter being shown as cross-hatched in FIG. 4. Roller 2 has an imperforate peripheral surface, and is formed of a metal core cylinder 4 on which is bonded a cylindrical shell or coating 5 of a resilient material, such as a natural or synthetic rubber like some polyurethane, adiprene or caprolactone shell devoid of perforations. The shell may be about 2 mm thick and have a hardness as measured by a penetrometer within the range of from 40 to 90 Shore A degrees, in a most preferred embodiment, and there 60 Shore A degrees. The axes of rotation and symmetry of rollers 1 and 2 are parallel and spaced apart a sufficient distance such that a narrow gap is defined between their peripheral surfaces where they most closely approach one another, which is called herein the zone of closest approach, and as the surfaces diverge from one another they further define therebetween a cusp-shaped space in which the yarn is formed, which space is called herein the zone of yarn formation and the cusp-zone or cusp-space. Actually, adjacent to the zone of closest approach in a portion of the cusp-space is the elongate zone parallel to the roller axes in which yarn formation occurs, which portion of the cusp-space is called hereinafter the throat, or narrow throat.

Roller 2 carries a cylinder 4 upon ball bearings 6 for free rotation about a shaft 7 which supports bearings 6. Shaft 7 in turn is rigidly supported in the respective bores in a pair of arms 8,9 which are pivotally mounted on bar 10 (FIG. 2), and about which arms 8,9 and thus roller 2 can be provided to increase or decrease the gap or zone of closest approach between rollers 1,2 outer peripheral surfaces.

Roller 1 includes the aforementioned cylindrical perforated portion 3 and imperforate extentions 11 and 12 which act to provide rigidity and support to portion 3. A suction tube 13 is mounted within roller 1 in the form of an elongate cylinder axially concentric with roller 1 and spaced in very close clearance within roller 1, of the order of 1 or 2 one-thousands of an inch, such that roller 1 may freely rotate about tube 13. Adjacent the throat a portion of tube 13 is formed with a slot 13' therethrough to communicate through the perforations through portion 3 of roller 1 thereat, as shall later be explained. Tube 13 is rigidly mounted by insertion of one of its ends within a bore 14 formed in a support member 15 which, in turn, is fixed to a frame member 16 of the apparatus with that end abutting member 16. In support 15, bore 14 opens out to form a larger diameter cylindrically shaped cavity to receive a bearing 18 therewithin to support the latter, and which bearing 18 rotatably supports an end of perforated roller 1. The other end of tube 13 is closed and extended in a reduced diameter to provide a boss 19 which supports another bearing 20 for in turn rotatably supporting a reduced diameter portion 21 formed at the other end of perforated roller 1. The interior space of tube 13 communicates through a duct 22 extending through frame member 16 with a source of suction (not shown).

Figure 1:
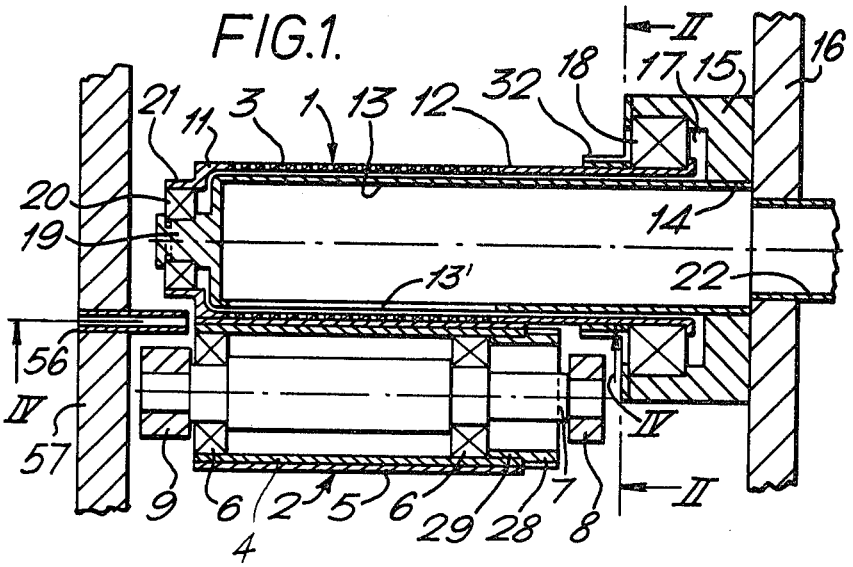
FIG. 1 is a plan view of the apparatus according to the invention, partially in section as viewed along line I—I of FIG. 2.
Figure 2:
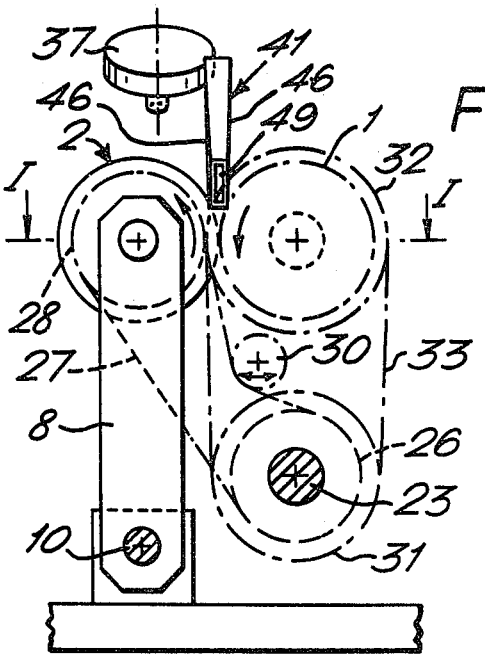
FIG. 2 is a section of the aforesaid apparatus when viewed along line II—II of FIGS. 1 and 3.
Figure 3:
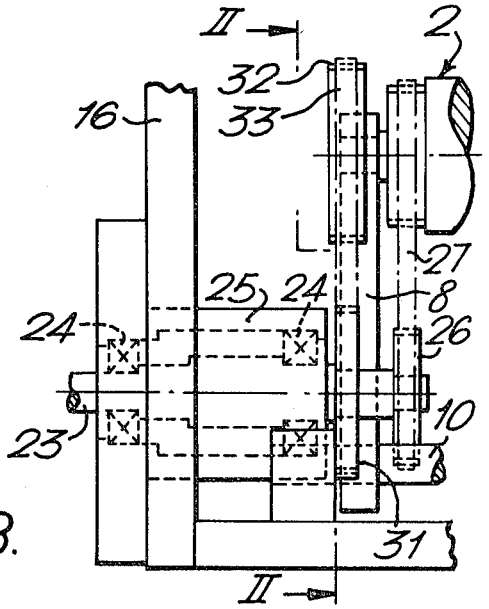
FIG. 3 is a partial side elevational view of the present apparatus showing the drive arrangements for rollers 1 and 2, with roller 1 removed for greater clarity of understanding.

Rollers 1 and 2 are rotatively driven axially parallel to one another and in the same sense, which latter in FIG. 2 is shown to be anticlockwise or counterclockwise, by drive interconnections to and by a motor (not shown). With reference to FIGS. 2 and 3, a shaft 23 of such interconnection at one end rotatably is supported within a housing 25 by a pair of spaced apart bearings 24,24, and at the other end drivingly supports a timing belt 27 mounted on a pulley wheel 26 at that other end of shaft 23. Belt 27 about pulley 26 also wraps about a pulley wheel 28 which in turn is supported by a spigot 29 extending from an end of imperforate roller 2 and also into the cavity of cylinder 4, as best seen in FIG. 1. Intermediate pulleys 26 and 28 a tension pulley wheel 30 engages belt 27 to impart a desired tension thereto and to permit adjustability of a change in the speed ratios of rollers 1 and 2 by using different size diameter wheels 26, and or 28. A timing belt pulley wheel 31 on shaft 23 intermediate pulley 26 and housing 25 is mounted to support and drive a timing drive belt 33 which in turn is mounted on and drives upper pulley wheel 32 drivingly connected to perforated roller 1. Pulley 32 is fixedly attached to the peripheral surface of roller 1 at a position adjacent bearing 18. The rotation thus provided to rollers 1 and 2, besides being in the same sense as hereinbefore described, is such that perforated roller 1 moves into the cusp space and downwardly through the zone of yarn formation to and through the zone of closest approach of roller 1 to roller 2; thus, also, imperforate roller 2 moves upwardly through the gap space or zone of closest approach of the rollers and thence upwardly and through the cusp space, or throat.

Figure 5:
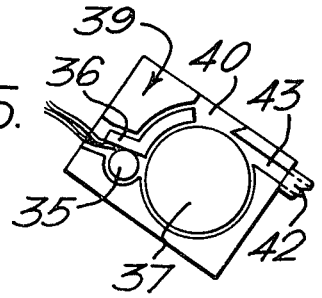
FIG. 5 in plan view shows the opening roller construction of the fiber feed means of the present apparatus.

A fiber feed apparatus of this spinner, generally indicated at 34 of FIG. 4, is shown to comprise in FIG. 5 of a sliver feed roller 35, a feed pedal 36, and a beater 37 mounted on a shaft 38 (FIG. 4) for rotation within a housing 39. Housing 39 has an opening 40 formed therein to permit ejection of separated foreign matter such as trash therethrough. Apparatus 34 is of a type well known in the open end spinning arts, such as is described in some detail in British Pat. No. 1,368,886.

Discrete fibers conveyed from apparatus 34 are carried in an air stream by a duct 41 having a mouth 45 (FIG. 4) opening or exiting within the throat or cusp space adjacent to the zone of yarn formation closely adjacent thereto and below it and just above the air gap or zone of closest approach between and of rollers 1 and 2. In this embodiment, a second airstream is impinged upon the fibers travelling towards the throat to change their axial direction to one more parallel to the axis of the elongate yarn strand being formed by twisting in the zone of yarn formation immediately below the opening of mouth 45. Detailed description of this means for fiber reorientation for its subsequent layering and twisting within the yarn formation zone is made in copending U.S. application Ser. No. 88,262 of Oct. 25, 1979, previously referenced, and which description is included herein by reference.

We claim:

1. In a yarn spinning apparatus, comprising, in combination, a pair of rollers, one having a perforate peripheral surface providing communication therethrough with an interior hollow space, and means associated therewith for providing a flow of air therethrough into said hollow space, and the other roller having a substantially imperforate peripheral surface;

means for mounting said rollers in close adjacency to one another for rotation about their respective axes such that said peripheral surfaces define therebetween an elongate throat space extending outwardly from a gap space separating said rollers at their points of closest adjacency;

fiber feed means for feeding discrete fibers to said throat space;

means for rotating said rollers concurrently and in the same rotational sense, and for thereby twisting said fed fibers to form a yarn in said throat space; and means for withdrawing said yarn as it is formed and for collecting the same;

the improvement comprising:

said means for feeding said fibers including means for delivering said fibers within said throat space to a yarn formation zone thereof adjacent said gap space; and said means for rotating said rollers including means for rotating said imperforate roller such that a point on said surface thereof is moved from said gap space outwardly through said yarn formation zone and throat space, and for concurrently rotating said perforate roller such that a point on its said peripheral surface is moved inwardly through said throat space and yarn formation zone to and through said gap space.

2. The improvement as in claim 1, wherein said means for delivering fibers include a duct having a mouth opening within said throat space and adjacent to said yarn formation zone.

3. The improvement as in claim 1, wherein said rollers are right circular cylinders whose axes are parallel one another and substantially horizontally oriented, and wherein said outward rotational movement is an upward movement and said inward rotational movement is a downward movement.

4. In an apparatus for open-end spinning of yarn comprising two rollers, means for mounting the rollers for rotation about respective axes arranged such that the peripheral surfaces of the rollers define between them an elongate throat adjacent the line of closest approach, one of the rollers having a perforated surface and having associated therewith means for developing an airstream therethrough and the other being imperforate, a fiber feed duct for feeding fibers such that they enter the throat, means for rotating the rollers such that the fibers in the throat are twisted to form a yarn and means for withdrawing the yarn along the throat, the improvement comprising in combination therewith said rollers, said means for mounting said rollers and said means for rotating said rollers are interconnected such that the perforated surface moves into the throat and the imperforate surface moves out of the throat, and said feed duct is positioned to extend into the throat.

* * * * *